US010697109B2

(12) United States Patent
Usui et al.

(10) Patent No.: US 10,697,109 B2
(45) Date of Patent: Jun. 30, 2020

(54) WASHING MACHINE

(71) Applicant: Toshiba Lifestyle Products & Services Corporation, Kawasaki-shi (JP)

(72) Inventors: Yoshinori Usui, Kawasaki (JP); Satoshi Nagai, Kawasaki (JP); Hiroshi Nishimura, Kawasaki (JP); Katsunori Matsushita, Kawasaki (JP)

(73) Assignee: Toshiba Lifestyle Products & Services Corporation, Kawasaki-shi (JP)

( * ) Notice: Subject to any disclaimer, the term of this patent is extended or adjusted under 35 U.S.C. 154(b) by 0 days.

(21) Appl. No.: 16/274,283

(22) Filed: Feb. 13, 2019

(65) Prior Publication Data

US 2019/0177903 A1 Jun. 13, 2019

Related U.S. Application Data

(63) Continuation of application No. PCT/JP2017/020465, filed on Jun. 1, 2017.

(30) Foreign Application Priority Data

Sep. 9, 2016 (JP) ..... 2016-176642
Jan. 26, 2017 (JP) ..... 2017-012076

(51) Int. Cl.
*D06F 39/08* (2006.01)
*D06F 17/12* (2006.01)
*D06F 35/00* (2006.01)

(52) U.S. Cl.
CPC ..... *D06F 39/088* (2013.01); *D06F 17/12* (2013.01); *D06F 35/002* (2013.01); *D06F 39/08* (2013.01)

(58) Field of Classification Search
CPC ..... D06F 39/08; D06F 39/088; D06F 35/002; D06F 17/12
See application file for complete search history.

(56) References Cited

U.S. PATENT DOCUMENTS 5,295,373 A * 3/1994 Lim ..... D06F 17/12 68/12.05
5,770,118 A * 6/1998 Lee ..... D06F 17/12 261/30

(Continued)

FOREIGN PATENT DOCUMENTS

CN 105297357 A 2/2016
CN 105544147 A * 5/2016

(Continued)

OTHER PUBLICATIONS

Machine Translation of JP 2016007308 to Uchiyama, Jan. 2016. (Year: 2016).*

(Continued)

*Primary Examiner* — Benjamin L Osterhout
(74) *Attorney, Agent, or Firm* — Oblon, McClelland, Maier & Neustadt, L.L.P.

(57) ABSTRACT

A washing machine includes: a washing tub in which clothes are stored; and a water supply mechanism for supplying water into the washing tub through a water supply path, the water being supplied from a water supply source. The water supply mechanism includes a water supply valve for opening and closing the water supply path, a water filling case for filling water into the washing tub, and a fine bubble generation device provided between the water supply valve and the water filling case and for generating fine bubbles.

12 Claims, 10 Drawing Sheets

(56) References Cited

U.S. PATENT DOCUMENTS

| | | | | |
|---|---|---|---|---|
| 6,094,948 | A * | 8/2000 | Hong | D06F 35/002 261/122.1 |
| 6,170,303 | B1 * | 1/2001 | Hong | D06F 17/12 134/102.2 |
| 6,662,600 | B1 * | 12/2003 | Field | D06F 39/02 134/102.1 |
| 6,868,701 | B2 * | 3/2005 | Lee | D06F 35/002 68/183 |
| 8,327,673 | B2 * | 12/2012 | Oak | D06F 35/002 68/183 |
| 8,418,510 | B2 * | 4/2013 | Oak | D06F 17/12 68/183 |
| 2004/0172985 | A1 * | 9/2004 | Mamiya | C11D 11/007 68/12.05 |
| 2009/0255299 | A1 * | 10/2009 | Hiro | D06F 25/00 68/19 |
| 2010/0122421 | A1 | 5/2010 | Sa | |
| 2011/0056030 | A1 * | 3/2011 | Bang | D06F 33/02 8/159 |
| 2012/0102661 | A1 * | 5/2012 | Kim | D06F 17/06 8/137 |
| 2012/0103025 | A1 * | 5/2012 | Nambu | C02F 1/42 68/12.23 |
| 2013/0145562 | A1 * | 6/2013 | Lee | D06F 39/088 8/137 |
| 2015/0204001 | A1 * | 7/2015 | Song | D06F 35/002 8/137 |
| 2016/0153134 | A1 | 6/2016 | Bang et al. | |

FOREIGN PATENT DOCUMENTS

| | | | |
|---|---|---|---|
| CN | 105544147 | A | 5/2016 |
| CN | 108474164 | A | 8/2018 |
| JP | 8-206390 | A | 8/1996 |
| JP | 2006-51173 | A | 2/2006 |
| JP | 2009-178195 | A | 8/2009 |
| JP | 2009-226208 | A | 10/2009 |
| JP | 2011-88979 | A | 5/2011 |
| JP | 2011-115359 | A | 6/2011 |
| JP | 2012-515634 | A | 7/2012 |
| JP | 2012-161588 | A | 8/2012 |
| JP | 2016-7308 | | 1/2016 |
| JP | 2016007308 | A * | 1/2016 |
| JP | 2017-113395 | A | 6/2017 |

OTHER PUBLICATIONS

Machine Translation of CN 105544147 to Zhang, May 2016. (Year: 2016).*

Combined Chinese Office Action and Search Report dated Feb. 20, 2019 in corresponding Chinese Patent Application No. 201780010151.7 (with English Translation of Category of Cited Documents), citing documents AA, AN, AP-AT therein, 7 pages.

International Search Report dated Aug. 1, 2017 in PCT/JP2017/020465 filed Jun. 1, 2017 (with English Translation).

le;2qJapanese Office Action dated Aug. 20, 2019, in Patent Application No. 2017-224566, 2 pages.

Korean Office Action dated Feb. 28, 2020 in Korean Patent Application No. 10-2019-7001363, citing documents AO, AP and AQ therein, 7 pages.

Office Action dated Jan. 21, 2020 in Japanese Patent Application No. 2017-224566, 3 pages.

* cited by examiner

WASHING MACHINE

CROSS REFERENCE TO RELATED APPLICATIONS

The present application is based on Japanese Patent Application No. 2016-176642 filed on Sep. 9, 2016 and Japanese Patent Application No. 2017-012076 filed on Jan. 26, 2017, whose contents are incorporated herein by reference.

TECHNICAL FIELD

An embodiment of the present invention relates to a washing machine.

BACKGROUND ART

In recent years, fine bubbles (ultrafine bubbles or micro bubbles) which are formed in water and have a diameter of, for example, several tens nm to several hundreds nm have gained attention. For example, Patent Literature 1 discloses a technique of using fine bubble water for washing in which a fine bubble generation device (UFB unit) is provided in a water supply path in a washing machine to generate numerous fine bubbles, and fine bubble water including the fine bubbles is used for washing. Using such fine bubble water enables to enhance dispersibility of detergent and permeability of detergent into clothes, thus achieving excellent cleaning action.

CITATION LIST

Patent Literature

Patent Literature 1: Japanese Patent Laid-Open No. 2016-7308

SUMMARY OF INVENTION

The above described fine bubble generation device is configured to increase flow rate of water and rapidly decrease pressure thereof by utilizing the so-called Venturi effect of fluid dynamics so that air dissolved in water is caused to precipitate in a large amount as minute air bubbles. When such a fine bubble generation device is provided in a washing machine in this way, it is desired to efficiently generate fine bubbles by means of a simple configuration.

Accordingly, a washing machine which is provided with a fine bubble generation device and capable of efficiently generate fine bubbles is provided.

A washing machine of an embodiment includes: a washing tub in which clothes are stored; and a water supply mechanism for supplying water into the washing tub through a water supply path, the water being supplied from a water supply source, in which the water supply mechanism is configured to include a water supply valve for opening and closing the water supply path, a water filling case for filling water into the washing tub, and a fine bubble generation device provided between the water supply valve and the water filling case and for generating fine bubbles.

Note that the term "fine bubble" in an embodiment is a concept including micro bubbles having a diameter of about 1 μm to several hundreds μm, and ultrafine bubbles having a diameter of about 50 nm to 1 μm.

DESCRIPTION OF EMBODIMENTS

Hereinafter, some embodiments which have been applied to a so-called vertical-axis type washing machine will be described with reference to the drawings. Note that among multiple embodiments, the like parts are given the like reference symbols to omit further illustration and repetitive explanation.

(1) First Embodiment

Figure 1:
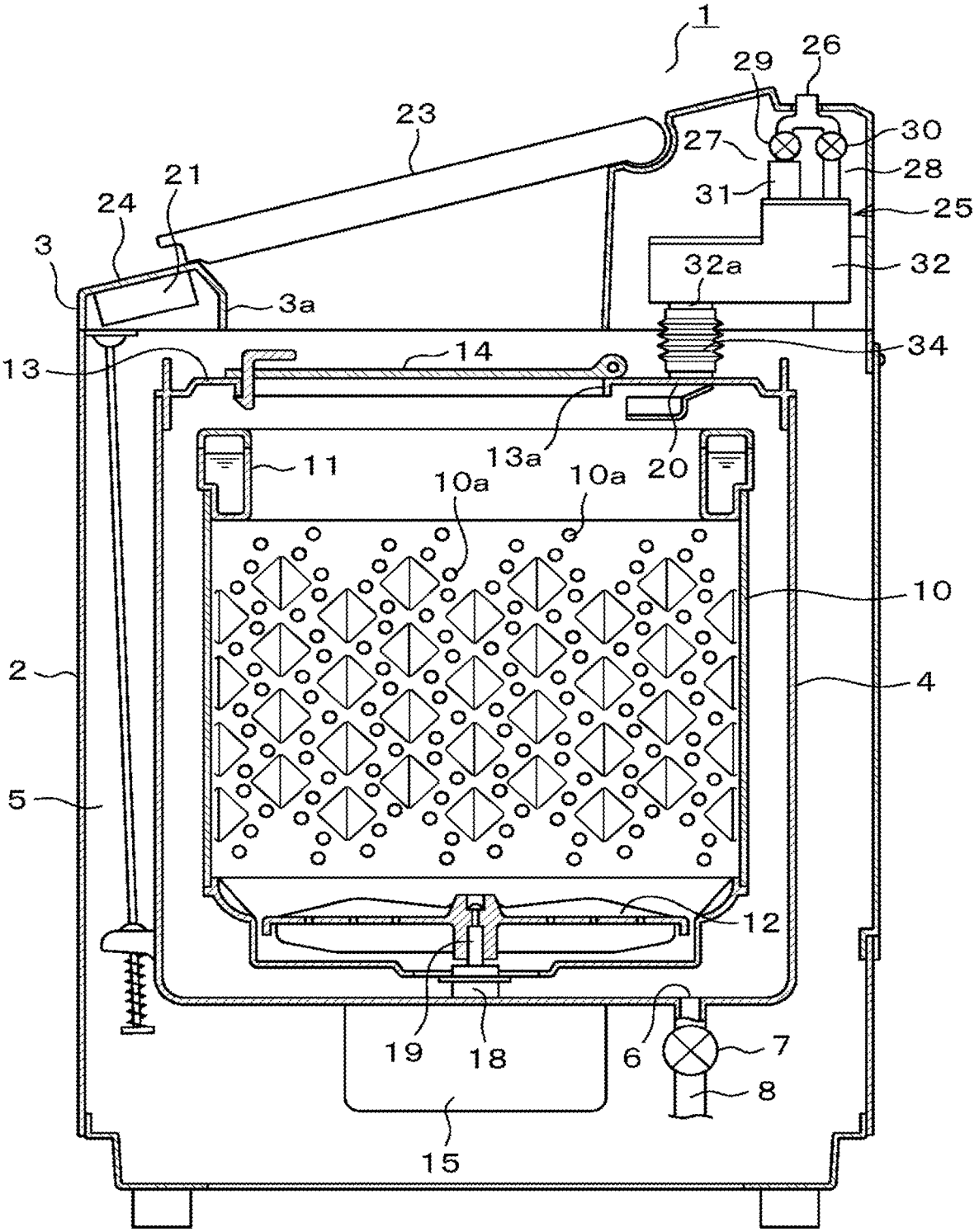
FIG. 1 is a longitudinal sectional view to schematically show the configuration of a washing machine according to a first embodiment.
Figure 2:
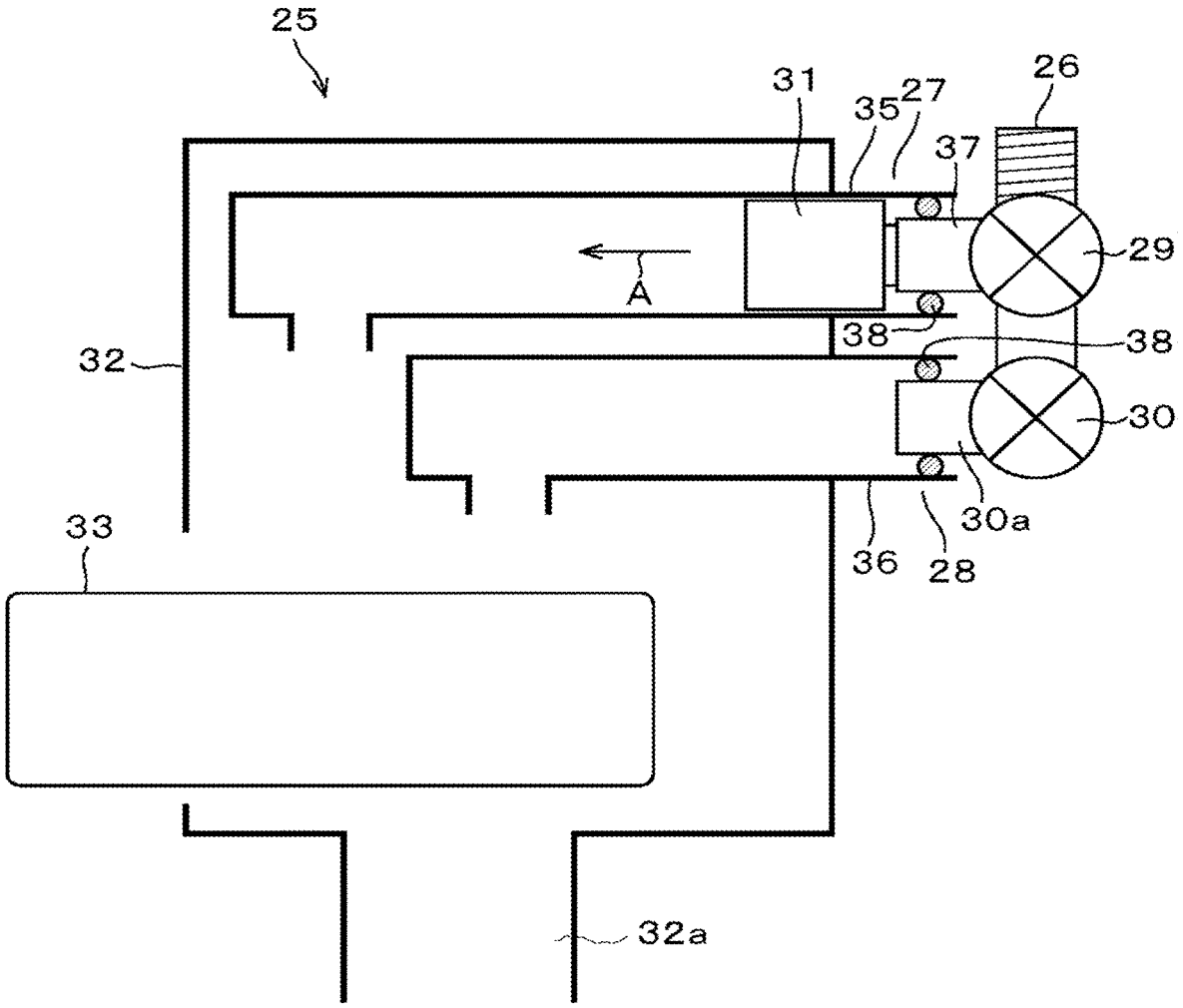
FIG. 2 is a diagram to schematically show the configuration of a water supply mechanism portion.
Figure 3:
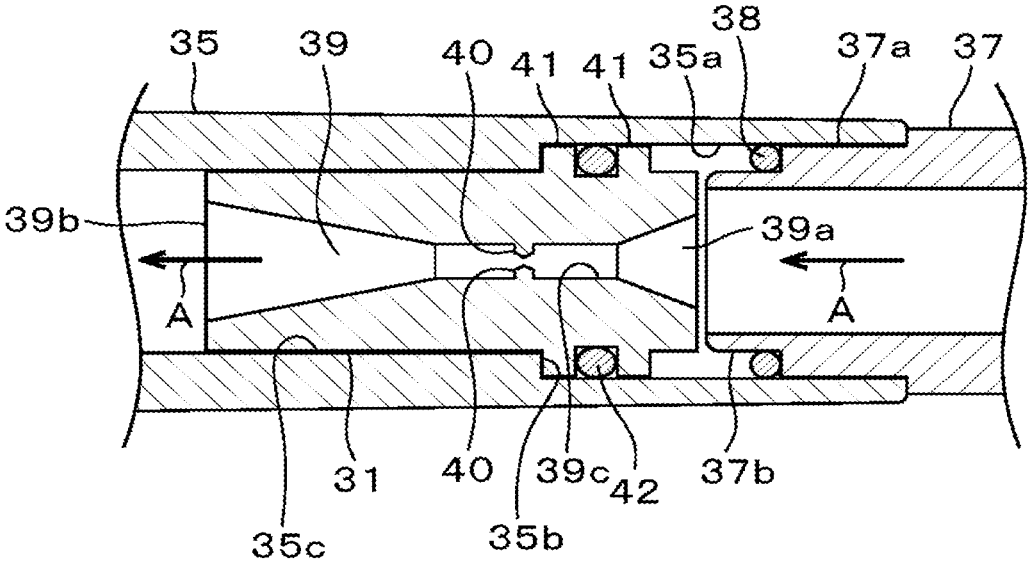
FIG. 3 is a sectional view to show the configuration of an assembly portion of a UFB unit.

Referring to FIGS. 1 to 3, a first embodiment will be described. FIG. 1 schematically shows an internal configuration of a washing machine 1 according to the present embodiment. First, the general configuration of the washing machine 1 will be described. Here, the washing machine 1 includes, for example, a top cover 3 made of synthetic resin on top of an outer box 2 which is generally formed of steel sheet into a rectangular box shape.

In the outer box 2, there is provided a water which can retain washing water, the water tub 4 being supported by being elastically suspended by an elastic hanging mechanism 5 of a known configuration. A drainage port 6 is formed in a bottom part of the water tub 4. A drainage passage B including an electronically controlled drainage valve 7 is connected to the drainage port 6. Note that, although not shown, an air trap is provided in the bottom part of the water tub 4, and a water level sensor for detecting the water level in the water tub 4 is provided via an air tube connected to the air trap.

Within the water tub 4, a vertical-axis type washing tub 10 which also acts as a dewatering tub is rotatably provided. The washing tub 10 has a bottomed cylindrical shape, and is formed with a large number of dewatering holes 10*a* in its peripheral wall part. For example, a liquid-sealed type rotation balancer 11 is attached to an upper end pa the washing tub 10. Moreover, a pulsator 12 that constitutes a stirrer is arranged in the inner bottom part of the washing tub 10. The washing tub 10 is configured to store clothes not shown so that washing operation consisting of steps of washing, rising, and dewatering etc. is performed.

In this arrangement, a water tub cover 13 is fitted onto the water tub 4. This water tub cover 13 is provided in its approximately central part with an opening part 13*a* for loading and unloading laundry, and is attached with an inner lid 14 for opening and closing the opening part 13*a*. Moreover, there is provided in a portion in the rear of the water tub cover 13 a water supply port 20 for supplying water into the water tub 4 from the water supply mechanism to be described below.

Moreover, in the outer bottom part of the water tub 4, a driving mechanism 15 of a known configuration is arranged. Although detailed illustration and description will be omitted, this driving mechanism 15 includes a washing machine motor (not shown) made up of, for example, an outer-rotor type DC 3-phase brushless motor. Along with this, the driving mechanism 15 includes a hollow tub shaft 18, a stirring shaft 19 passing through the tub shaft 18, a clutch mechanism for selectively transmitting rotational driving force of the washing machine motor to the shafts 18, 19, and the like. The washing tub 10 is connected to an upper end of the tub shaft 18, and the pulsator 12 is connected to an upper end of the stirring shaft 19.

The clutch mechanism is equipped with, for example, a solenoid a driving source, and is controlled by a control device 21 mainly consisting of a computer. As a result of this, the clutch mechanism transmits the driving force of the washing machine motor with the washing tub 10 being fixed (stopped) during washing and during rising (washing step) to a pulsator 12 via the stirring shaft 19 to directly drive the pulsator 12 to normally and reversely rotate. Further, during dewatering (dewatering step), the clutch mechanism transmits the driving force of the washing machine motor to the washing tub 10 through the tub haft 10, with the tub shaft 18 and the stirring shaft 19 being connected, to directly drive the washing tub 10 (and the pulsator 12) to rotate it in one direction at a high speed.

The top cover 3 takes on a thin hollow box shape whose lower surface opens and whose upper surface is downwardly inclined toward the front. An outlet and inlet port 3*a* of laundry having a substantially circular shape is located above the washing tub 10 (above the opening part 13*a* of the water tub cover 13) is formed in a central part of the top cover 3. A lid 23 having a generally rectangular panel shape and for opening and closing the outlet and inlet port 3*a* is provided on the upper surface of the top cover 3.

Moreover, an operating panel 24 having an elongated shape is provided on a front side part of the upper surface of the top cover 3. Although not shown in detail, this operating panel 24 is configured to include an operating part for a user to perform turning on/off of the power supply and various settings/instructions etc. for the washing machine 1, and a display part for performing necessary display. The above described control device 21 (electronic unit) is provided on the back side of the operating panel 24.

Then, as shown in FIG. 2 as well, a water supply mechanism 25 for supply water supplied from a water supply source, a tap water in this case, into the water tub 4 (washing tub 10) through a water supply path is provided in the rear part of the top cover 3. In the present embodiment, the water supply mechanism 25 includes a connection port 26, a first and second water supply paths 27 and 28 which are bifurcated to extend from the connection port 26, and a first and second water supply valves 29 and 30 for opening and closing the water supply paths 27 and 28, respectively. Further, the water supply mechanism 25 includes a UPS unit 31 as a fine bubble generation device provided in the first water supply path 27, a water filling case 32, and the like.

Among them, the connection port 26 is connected with a tip end part of a connection hose connected to a faucet of tap water not shown so as to be supplied with water at a predetermined tap water pressure for household use (for example, about 1.0 to 3.0 kgf/cm$^2$ (0.1 to 0.29 MPa)). As shown in FIG. 2, the first water supply path 27 and the second water supply path 28 have their tip end parts respectively connected to the upper part of the water filling case 32. The water filling case 32 is provided a first inlet pipe 35 and a second inlet pipe 36 as an inlet part ater. The first water supply path 27 (an outlet pipe 37 as an outlet part of a first water supply valve 29) is connected to the inlet pipe 35. The second water supply path 28 (an outlet part 30*a* of a second water supply valve 30) is connected to the second inlet pipe 36. Where, the bore of the first inlet pipe 35 is different from the bore of the second inlet pipe 36, and for example, the bore of the second inlet pipe 36 is configured to be larger than that of the first inlet pipe 35.

The first water supply valve 29 and the second water supply valve 30, which are made up of an on-off valve that electromagnetically opens and closes, are controlled by the control device 21 to open and close the first water supply path 27 and the second water supply path 28, respectively. The water filling case 32 forms, as well known, a box shape, within which a detergent storage case 33 is provided so as to be drawable. The base end side of a flexible water supply hose 34 is connected, as shown in FIG. 1, to the outlet part 32*a* of the lower part of the water filling case 32, and the tip end part of the water supply hose 34 is connected to the water supply port 20 of the water tub cover 13.

As a result of this, when the first water supply valve 29 is opened, tap water it supplied from the first inlet pipe 35 through the first water supply path 21 into the water filling case 32. When detergent is stored in the detergent storage case 33, water flows while dissolving the detergent, being supplied from the outlet part 32*a* into the water tub 4 through the water supply hose 34. In this arrangement, ac described below, as a result of that the water flowing through the first water supply path 27 is passed through the UFB unit 31, the water is transformed into a fine bubble water containing large amount of fine bubbles and is supplied into the water filling case 32.

On the other hand, when the second water supply valve 30 is opened, tap water is supplied from the second inlet pipe into the water filling case 32 through the second water supply path 28. When the detergent is stored in the detergent storage case 33, the water flows while dissolving the detergent, being supplied from the outlet part 32*a* into the water tub 4 through the water supply hose 34. In this case, tap water without containing fine bubble is supplied as it is into the water tub 4 through the second water supply path 28. Also in this case, the flow rate of water in the second water supply path 28 is configured to be more than that in the first water supply path 27.

Meanwhile, in the present embodiment, a UFB unit which is a fine bubble generation device utilizing the principle of Venturi tube is provided so as to be positioned between the first water supply valve 29 of the first water supply path 7 and the inlet part of the water filling case 32. In this situation, as shown in FIG. 3, the UFB unit 31 is assembled so as to be positioned and interposed between the outlet pipe 37 of the first water supply valve 29 and the first water inlet pipe e water ling case 32. That is, the UFB unit 31 is provided in the outlet part of the first water supply valve 29, and an outflow port of the UFB unit 31 is connected to the inlet part of water of the water filling case 32. Hereinafter, the UFB unit 31 will be described with reference to FIG. 3.

That is, the outlet pipe 37 of the first water supply valve 29 takes on a tubular shape, and extends toward the first inlet pipe 35 side (the left hand side in the figure) of the water filling case 32. The tip end part of the outlet pipe 37 is formed with steps such that the diameter of its outer peripheral surface is decreased in two steps, and these parts are referred to as a first small diameter part 37*a* and a second small diameter part 37*b* in the order from the right hand side (from the large diameter side). In contrast, the first inlet pipe 35 of the water filling case 32 extends rightward in the figure toward the first water supply valve 29 side, and is formed in its tip inner peripheral part with a thin wall part 35*a* which is positioned on the tip end side, and in which the inner diameter is slightly increased (become thin-walled). Of the inner peripheral part of the first inlet pipe 35, a portion inward from the thin wall part 35*a* is formed into a small diameter part 35*c* with a step 35*b*.

In this situation, an inner diameter dimension of the thin wall part 35*a* corresponds to an outer diameter dimension of the first small diameter part 37*a* of the outlet pipe 37. An inner diameter dimension of the small diameter part 35*c* corresponds to an outer diameter dimension of the outflow port side of the UFB unit 31. With the UFB unit 31 being inserted from the right side in the figure into the first inlet pipe 35 of the water filling case 32, the outlet pipe 37 of the first water supply valve 29 is connected to the first inlet pipe 35 in such a way that the outer peripheral circumference of the first small diameter part 37*a* is fitted into the inner peripheral surface of the thin wall part 35*a*. Moreover, in this state, an O-ring 38 is provided between the outer peripheral surface of the small diameter part 37*b* of the outlet pipe 37 and the inner peripheral surface of the thin wall part 35*a*.

The UFB unit 31, which is made of, for example, synthetic resin, takes on a generally cylindrical shape with a left and right direction as its axial direction, and is formed with a flow passage 39 passing through in the left and right direction in the figure in its central part (axial part). Water flows in this flow passage 39 in an arrow A direction (from right to left in the figure). The outer diameter dimension of the UFB unit 31 corresponds to the inner diameter dimension of the first inlet pipe 35. Along with this, in a rightward area of a midway part of the outer peripheral wall of the UFB unit 31, a ring-shaped convex parts 41, 41 are integrally formed in two positions with a small interval in the axial direction.

This UFB unit 31 is configured to be inserted into the first inlet pipe 35 from the opening side (right side in the figure) to be attached. In that situation, one (left side in the figure) convex part 41 locks against a step 35*b* portion in the first inlet pipe 35, thus working as a stopper. Moreover, in this situation, an O-ring 42 is provided between the outer peripheral surface of the UFB unit 31 and the inner peripheral surface of the thin wall part 35*a* of the first inlet pipe 35 as to be positioned between the two convex parts 41, 41.

The flow passage 39 opens in both left and right end surfaces in the figure of the UFB unit 31, with the right side in the figure being referred to as an inflow port 39*a* and the left side in the figure as an outflow port 39*b*. Then, in an intermediate part of the flow age 39, a narrowed part 39*c* where the flow passage sectional area becomes minimum is formed in a form having a fixed length. The flow passage 39 is configured to have a tapered shape in which the flow passage sectional area gradually decreases in a section from the inflow port 39*a* to the narrowed part 39*c*, and a tapered shape in which the flow passage sectional area gradually increases in a section from the narrowed part 39*c* to the outflow port 39*b*.

Further, the UFB unit 31 is provided with four protruding parts 40 (only two of them are shown) so as to further narrow the flow passage of the narrowed part 39*c*. These protruding parts 40 are provided at a 90 degree interval so as to be inwardly convex from the outer peripheral side of the narrowed part 39*c*, and as a result of this, the cross section of the narrowed part 39*c* is formed like a cross-shaped (X-shaped) slit. In the present embodiment, the protruding part 40 is made of synthetic resin and is integrally formed with the UFB unit 31. The protruding part 40 may also be made from another member.

In such UFB unit 31, when water flows into the flow passage 39 from the inflow port 39*a* upon opening of the first water supply valve 19, the flow rate is increased and the pressure is rapidly decreased due to so-called Venturi effect of fluid dynamics as a result of the flow passage sectional area being narrowed to the narrowed part 39*c*. As a result of this, it is possible to make air dissolved in water to precipitate in a large amount as minute bubbles. In this case, it is configured such that the flow direction of water to be discharged from the outlet pipe 37 of the first water supply valve 29 and the flow direction of water in the flow passage 39 of the UFB unit 31 become the same direction (arrow A direction).

By the UFB unit 31 of the present embodiment, it is possible to generate a large amount of fine bubbles, including ultrafine bubbles having a diameter of about 50 nm to 1 μm, and micro bubbles having a diameter of about 1 μm to several hundreds μm. By passing through the UFB unit 31 in this way, water containing a large amount of fine bubbles (hereinafter, referred to as fine bubble water) is flown out from the outflow port 39*b*. Then, the fine bubble water flows into the water filling case 32 (the detergent storage case 33) and is filled into the water tub 4 from the water supply port 20 while dissolving the detergent. Note that details regarding this UFB unit 31 are described in Japanese Patent Application No. 2014-129097 relating to the former application of the present applicant.

In this occasion, as described in the following description of operation, the control device 21 supplies fine bubble water through the UFB unit 31 by opening the first water supply valve 29 (the second water supply valve 30 is closed) during water supply at the start of washing step mainly by means of its software configuration. As a result of this, washing water in which detergent has dissolved into fine bubble water is stored in the water tub (washing tub 10) and the washing step is carried out. Moreover, the control device 21 is adapted to open the second water supply valve 30 (the first water supply valve 29 is closed) to supply water in a rinsing step etc. after the washing step.

Next, operations and effects of the washing machine 1 of the above described configuration will be described. Upon starting washing operation, the user stores clothes to be washed in the washing tub 10 and have a predetermined amount of detergent be stored in the detergent storage case 33 of the water filling case 32. Then, starting operation is performed on the operating panel 24. Then, the control device 21 automatically performs washing operation consisting of steps of washing, rinsing, dewatering, etc. In this occasion, first, during water supply at the start of washing step, the first water supply valve 29 is opened.

As a result of this opening of the first water supply valve 29, water from a tar water supply passes through the UFB unit 31, and during which a large amount of fine bubbles are generated thereby forming fine bubble water to be supplied to the water filling case 32. Then, the fine bubble water is supplied into the water tub 4 while dissolving the detergent in the detergent storage case 33. When water is supplied to a predetermined level in the water tub 4, the first water supply valve 29 is closed, and the washing step is started in which the pulsator 12 is driven to normally and reversely rotate. When the washing step of a predetermined time is finished, the pulsator 12 is stopped and drainage from the water tub 4 is performed, successively followed by rinsing and dewatering steps. In these rinsing and dewatering steps, the second water supply valve 30 is opened so that the water from a tap water supply is supplied from the water filling case 32 into the water tub 4 through the second water supply path 28.

The above described fine bubbles undergo Brownian motion, which generates irregular motion, in a liquid such as water, and since the velocity of the motion is higher than the floating velocity, the fine bubbles have characteristics that they remain in the liquid over a long period of time. Then, since the surface of fine bubble is negatively charged, it plays a role of adsorbing detergent components (surfactant), which are contained in a washing water as lumps, in such a way to break them up, thereby improving dispersibility of detergent. Fine bubbles repel each other and never be joined together. Further, a fine bubble which has adsorbed detergent components in that way can easily enter into a gap (for example, of 10 μm) between fabrics of clothes, thus efficiently bringing the detergent into the clothes and removing dirt, and prevent the dirt from redepositing to the clothes.

In this case, since it is configured such that water is transformed into a fine bubble water by the UFB unit 31, and thereafter detergent is added to the fine bubble water, it is possible to effectively disperse detergent in the washing water in which fine bubble concentration is high. Note that on the contrary to this, when fine bubbles are generated after the detergent is added into water, the washing water will be excessively bubbled and it will become impossible to generate minute fine bubbles sufficiently. As a result of that, there is a risk that the concentration of fine bubble is lowered.

Here, in the UFB unit 31 as a fine bubble generation device utilizing the Venturi effect, it is necessary to flow water under a substantially high water pressure to generate minute bubbles. As the water supply source for the washing machine 1, generally a tap water supply is used. By utilizing the tap water with as little pressure drop as possible, it becomes possible to effectively generate a large amount of fine bubbles with the UFB unit 31 without using a special pressurizing device. In particular, the present embodiment is configured such that the flow direction of water discharged from the outlet pipe 3 of the first water supply valve 29 is the same as the flow direction of water in the flow passage 39 of the UFB unit 31. As a result of this, the resistance of flow passage in the first water supply path 27 to the UFB unit 31 can be reduced, thereby suppressing decrease of water pressure, and allowing efficient generation of fine bubbles.

Owing to such function of fine bubbles, the washing step is performed by using washing water in which detergent is dissolved into fine bubble water containing innumerable fine bubbles. As a result of this, excellent cleaning action can be achieved. Moreover, since the second water supply path 28 which does not pass through the UFB unit 31 is provided in the water supply mechanism 25, it is possible to supply water containing no fine bubble into the water tub 4 without passing through the UFB unit 31 during rising, etc. Therefore, during water supply such as during rising, it becomes possible to relatively increase the flow rate of water, thereby performing water supply within a shorter period of time.

In this way, according the present embodiment, the UFB unit 31 for generating fine bubbles is provided, in which the UFB unit 31 is positioned between the first water supply valve and the water filling case 32. This makes it possible to provide water, which has been discharged from the first water supply valve 29 and has a relatively high water pressure, to the UFB unit 31. As a result of this, excellent effect is can be achieved that fine bubbles can be efficiently generated with the LED unit 31 without need of providing a special pressurizing device for increasing water pressure. In this occasion, it is possible to provide the UFB unit 31 in the upstream of the detergent storage case 33 of the water filling case 32, and moreover to retain the UFB unit 31, which is subjected to high water pressure, by means of a simplest configuration.

Moreover, especially in the present embodiment, a UFB unit 31 which has a compact and simple configuration is adopted as the fine bubble generation device. In addition to this, configuration is made such that the UFB unit 31 is provided so as to be interposed between the outlet pipe 37 of the first water supply valve 29 and the first inlet pipe 35 of the water filling case 32. This makes it possible to achieve merits in that fine bubbles may be efficiently generated by using a relatively high water pressure and ease of assembling the DFB unit 31 is also improved. Further, since the bores of the first inlet pipe 35 and the second inlet pipe 36 of the water filling case 32 are made different, it is possible to prevent erroneous insertion of the USE unit 31.

(2) Second Embodiment

Next, a second embodiment will be described with reference to FIGS. 4 to 9. Difference between the second embodiment and the above described first embodiment is in the configuration of a UFB unit 51 which is a fine bubble generation device utilizing the principle of the Venturi tube. In the above described first embodiment, the UFB unit 31 is configured to be, for example, an integral article made of synthetic resin. In contrast to this, in the second embodiment, the UFB unit 51 is formed by combining two parts of an upstream side flow passage member 52 and a downstream side flow passage member 53.

Figure 4:
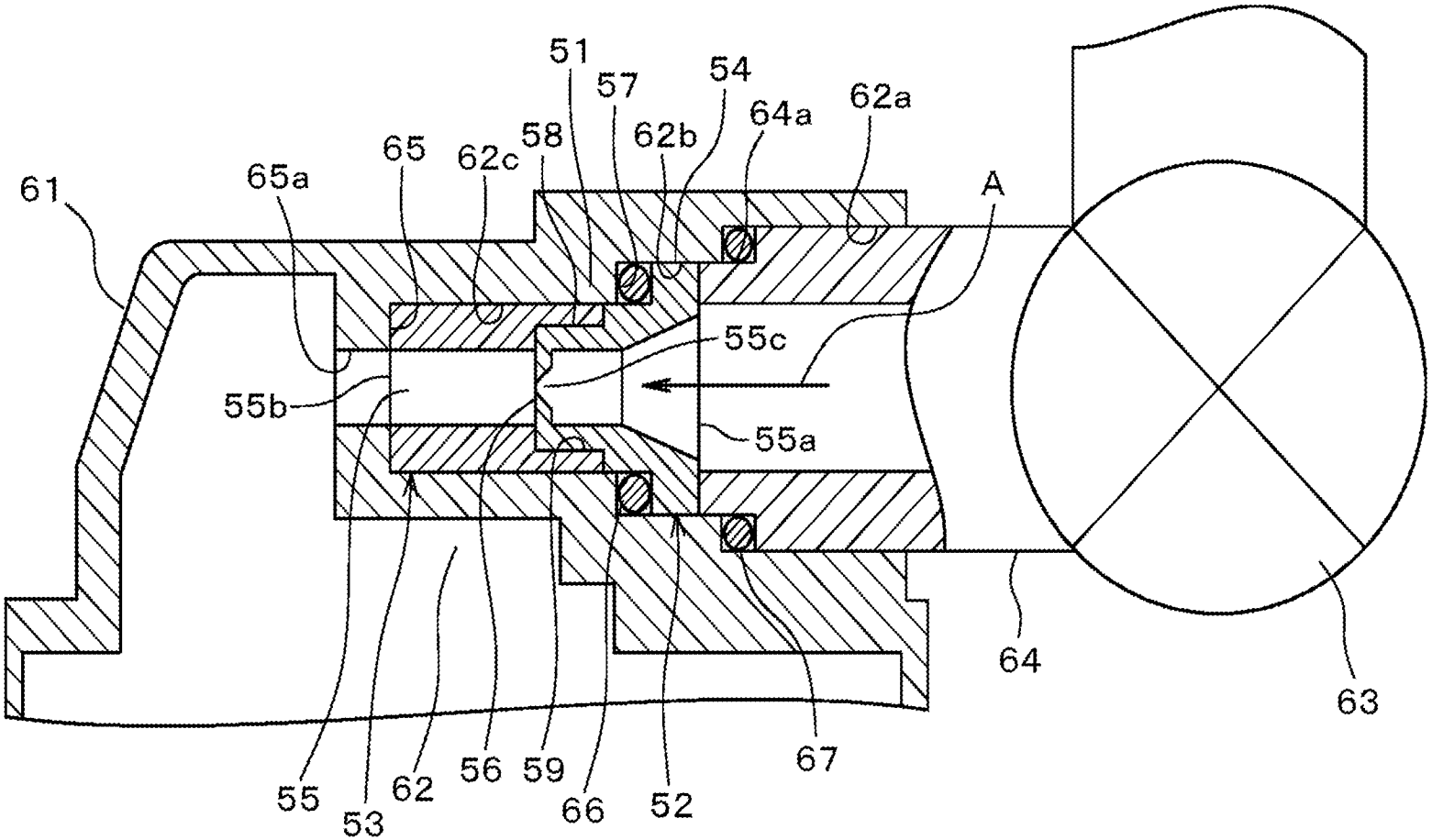
FIG. 4 is a sectional view to show the configuration of an assembly portion of the UFB unit according to a second embodiment.
Figure 8:
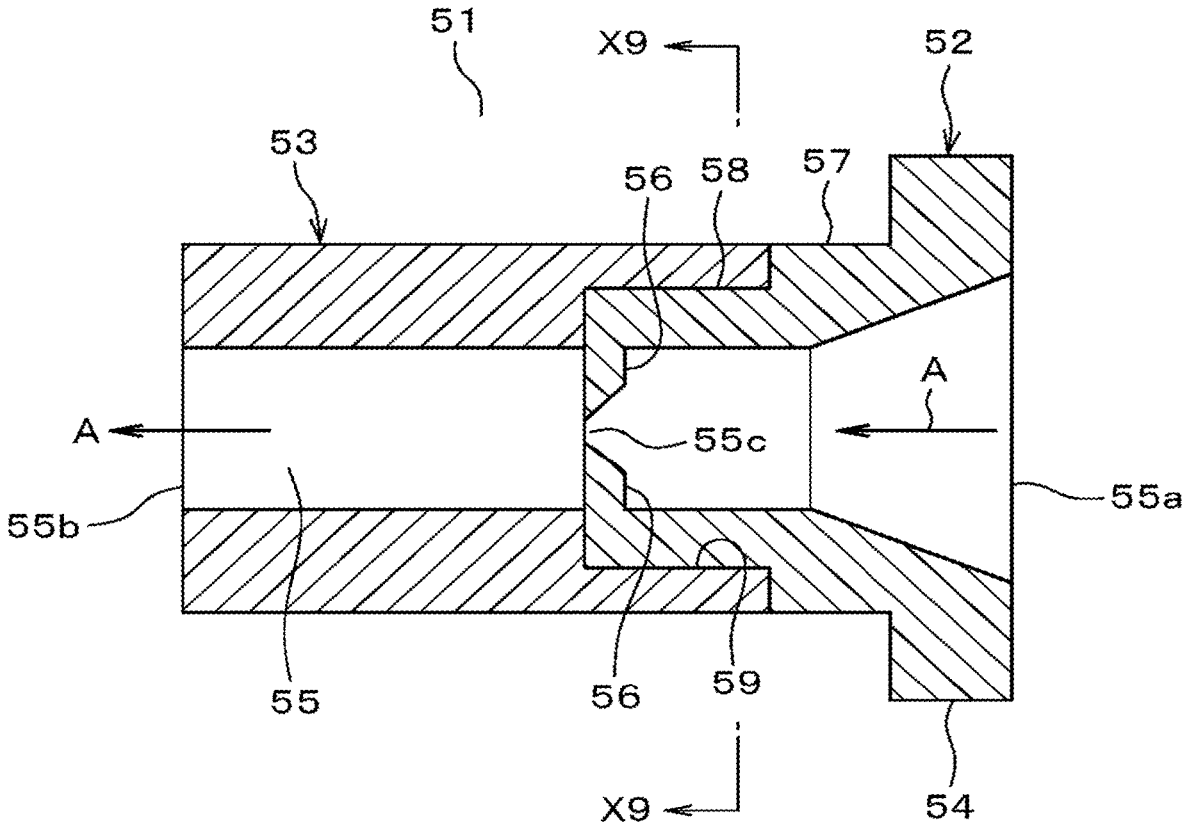
FIG. 8 is a sectional view of the UFB unit.

That is, the UFB unit 51 takes on, as shown in FIGS. 8 and 4, etc., generally a cylindrical shape which has a flange part 54 at a rear end prat (right end prat in the figure) with its axial direction as the right and left direction in the figure. At a central part (axial part) of the UFB unit 51, a flow passage 55 which passes through in the left and right direction in the figure and in which water flows in the arrow A direction is formed. This flow passage 55 is arranged such that an opening part on the right side in the figure is referred to an inflow port 55*a*, and an opening part of the left side in the figure as an outflow port 55*b*. Then, a narrowed part 55*c* is formed by a protruding part 56, which protrudes to the inner circumference side, in an intermediate part of the above described flow passage 55. The flow passage 55 is configured to have a tapered shape, in which the flow passage sectional area gradually decreases, in a range of a length of ¼ of the whole length from the inflow port 55*a*, and the remaining part is configured to have a straight shape having a substantially constant inner diameter excepting the narrowed part 55*c*.

Figure 5:
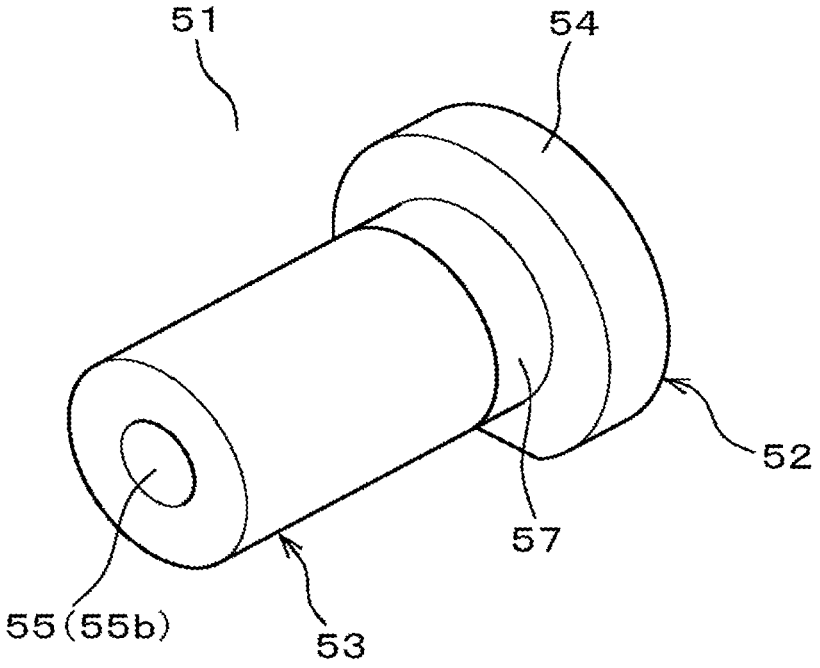
FIG. 5 is a perspective view to show the UFB unit viewed from the downstream side.
Figure 6:
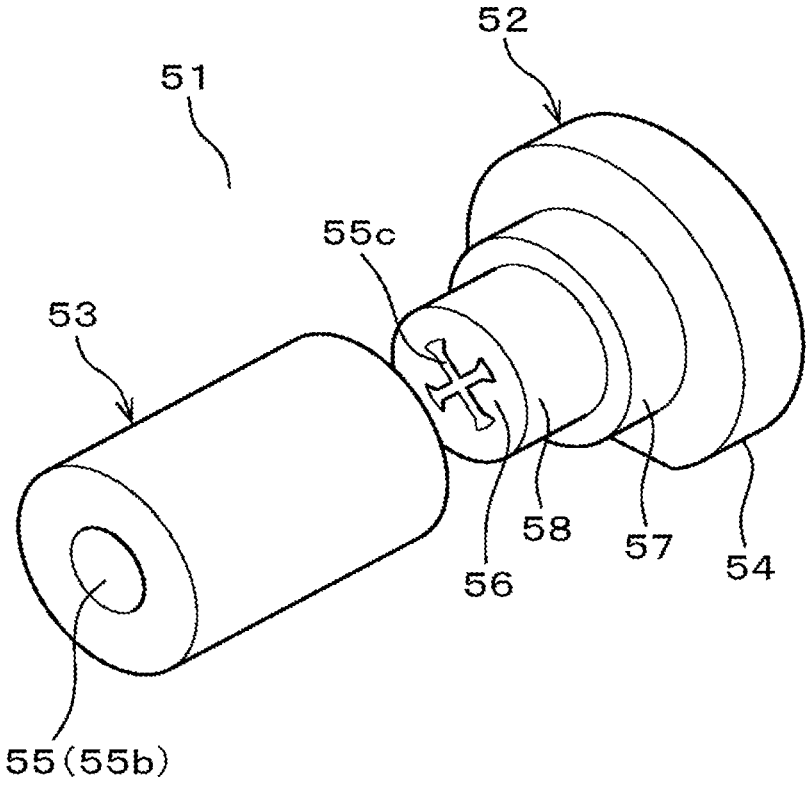
FIG. 6 is an exploded perspective view of the UFB unit viewed from the downstream side.
Figure 7:
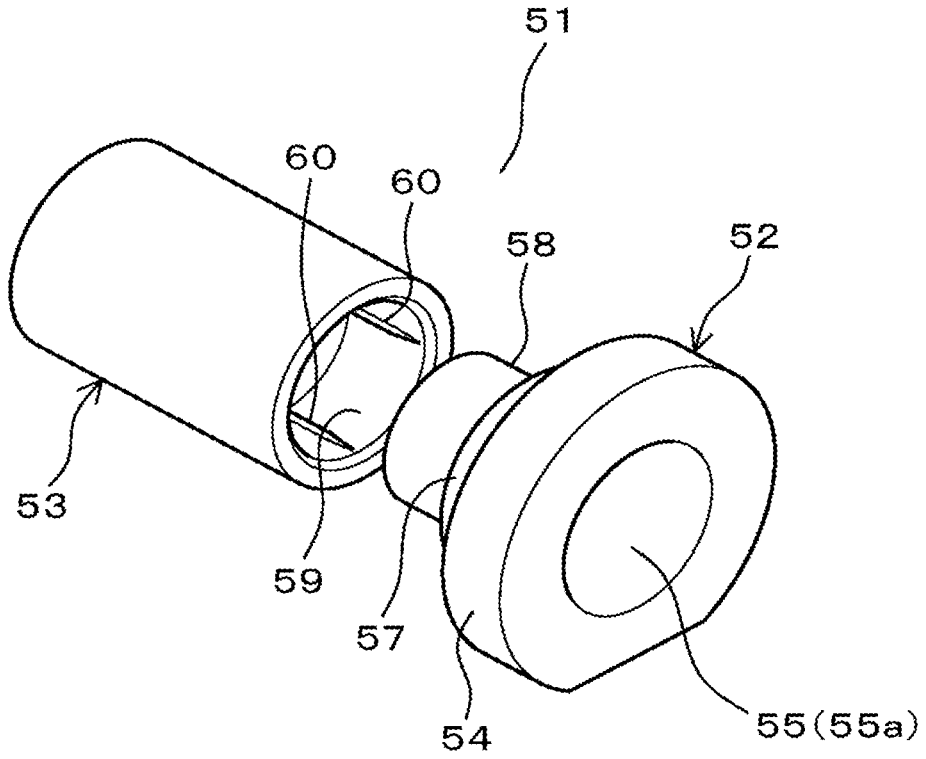
FIG. 7 is an exploded perspective view of the UFB unit viewed from the upstream side.

As described above, the UFB unit 51 includes an upstream side flow passage member 52 and a downstream side flow passage member 53, which look like as if they are bisected members, and is formed by combining them. The upstream side flow passage member 52 constitutes the upstream side of the flow passage 55 of the UFB unit 51, and integrally includes a protruding part 56 which narrows the flow passage sectional area of the wed part 55*c*. The downstream side flow passage member 53 constitutes a more downstream side than the protruding part 56 of the flow passage 55 of the UFB unit 51. As shown in FIGS. 5 to 7, among them, the upstream side flow passage member 52 is made of synthetic resin, and integrally includes a trunk part 57 having a slightly smaller diameter on the tip end side (left side in the figure) of the flange part 54, and includes a small diameter part 58 having a further smaller diameter on the tip end side of the trunk part 57. Inside the upstream side flow passage member 52, as shown in FIGS. 4 and 8, an upstream side half part of the flow passage 55 is formed.

Figure 9:
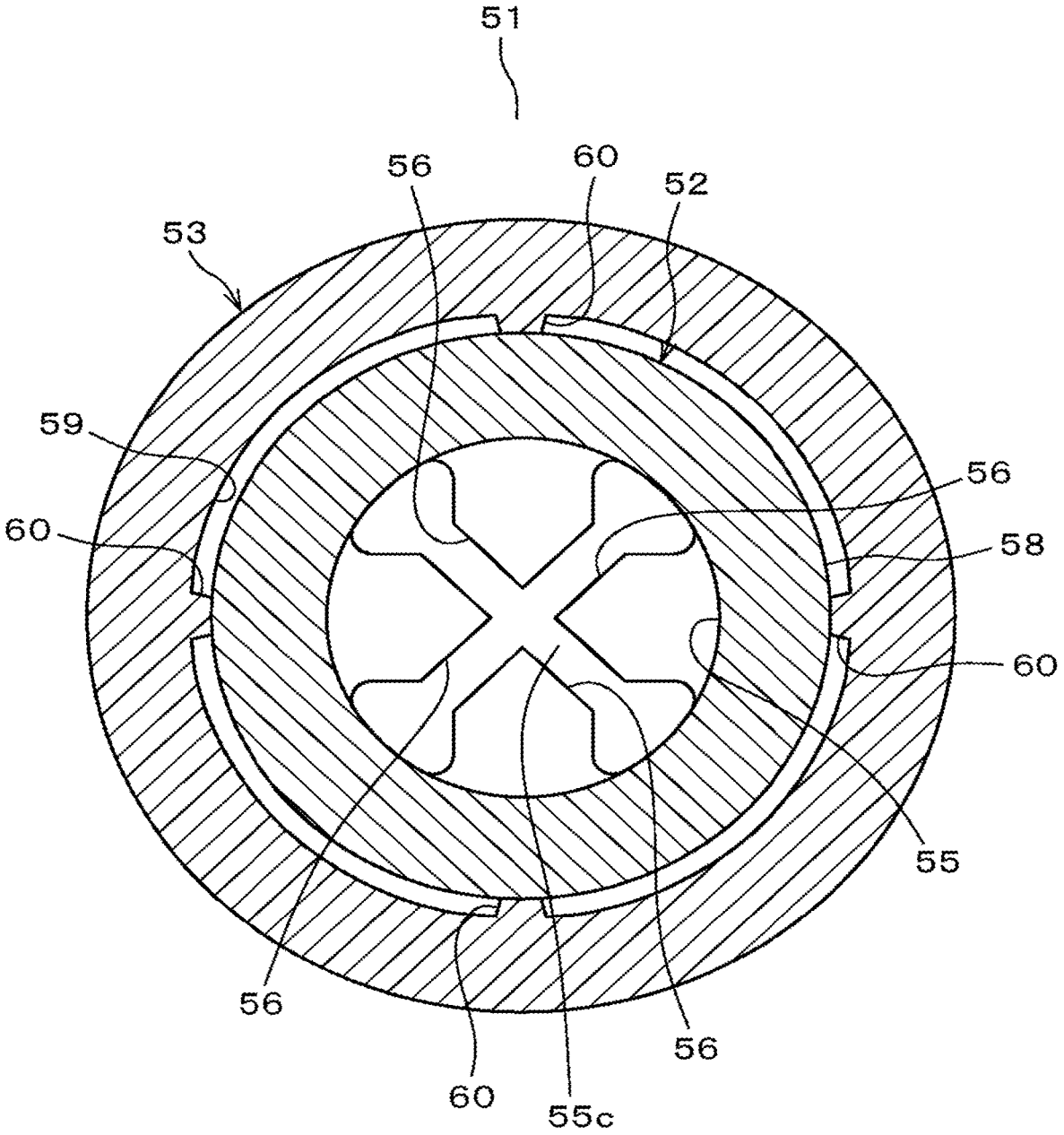
FIG. 9 is an enlarged longitudinal sectional view taken along X9-X9 line of FIG. 8.

In this situation, at the tip end of the small diameter part 58, a protruding part 56 which protrudes from the inner peripheral surface of the flow passage 55 to the center side is integrally formed. As shown in FIG. 9, the protruding part 56 is positioned at four places including upper and lower, and left and right places (90 degree interval) in the figure and extends toward the inner peripheral side (center of flow passage) in a form of a pointed tip end. As a result of this, the flow passage 55 is narrowed, and a portion where the flow passage sectional area of the narrowed part 55*c* is smallest is formed like an Y-shaped (cross shaped) slit.

In contrast to this, the downstream side flow passage member 53 takes on a cylindrical shape having a substantially equal outer diameter to that of the trunk part 57 as shown in FIGS. 4 to 8. On the base end side (right end side in the figure) of the downstream side flow passage member 53, a circular concave part 59 into which the small diameter part 56 of the upstream side flow passage member 52 is fitted is formed. In an inner part. (central part) of the downstream side flow passage member 53, a straight hole constituting a downstream side half part of the flow passage 55 is formed in such a way to pass through in the left and right directions in the figure.

In this case, as shown in FIG. 9, the inner diameter dimension of the circular concave part 59 is configured to be slightly larger than the outer diameter dimension of the small diameter part 58. As shown in FIG. 7 as well, in the inner peripheral surface of the circular concave part 59, a plurality of, for example, four press-fit ribs 60 are integrally provided at an interval of 90 degree and extend in the axial direction (left and right direction). As a result of this, as shown in FIG. 9, as the small diameter part 58 of the upstream side flow passage member 52 is inserted (pressed) into the circular concave part 59 of the downstream side flow passage member 53, the press-fit rib 60 deforms in such a way to be crushed thus firmly fixing the small diameter part 58 with the circular concave part 59.

On the other hand, as shown in FIG. 4, an inlet pipe (first inlet pipe) 62 as an inlet part of water is integrally provided in the water filling case 61. An outlet pipe 64 of the water supply valve (first water supply valve) 63 is connected to this inlet pipe 62. The outlet pipe 64 takes on a circular pipe shape, and step is formed in its tip part, thus providing a small diameter part 64*a* in which the outer peripheral surface has a small diameter. The UFB unit 51 is attached so as to be interposed between the outlet pipe 64 of the water supply valve 63 and the inlet pipe 62 of the water filling case 61.

The inlet pipe 62 takes on a shape in which its inner diameter decreases in three steps in an order from the entrance side (right side in the figure), and is provided with a first large diameter part 62*a*, a second large diameter part 62*b*, and a small diameter part 62*c*. The inner diameter dimension of the first large diameter part 62*a* corresponds to the outer diameter of the outlet pipe 64 (fitting is possible). The inner diameter dimension of the second large diameter part 62*b* corresponds to the outer diameter dimensions of the small diameter part 64*a* of the outlet pipe 64 and the flange part 54 of the UFB unit 51 (fitting is possible). The inner diameter dimension of the small diameter part 62*c* corresponds to the outer diameter dimension of the UFB unit 51 (fitting is possible). A rib 65 by which the tip end surface of the UFB unit 51 is locked is provided in the end part on the deeper side (left side in the figure) of the inlet pipe 62. In the central part of the rib 65, a communication hole 65*a* which continues in an equal diameter with the outflow port 55*b* of the flow passage 55 and is in communication with inside the water filling case 61 (detergent storage case) is formed.

As shown in FIG. 4, the UFB unit 51 is inserted in the deeper side of the inlet pipe 62 with the upstream side flow passage member 52 and the downstream side flow passage member 53 being combined. As a result of this, the tip end surface of the UFB unit 51 (downstream side flow passage member 53) comes into abutment with the rib 65. At the same time, the outer circumference excepting the rear end part of the UFB unit 51 (mainly the outer circumference of the downstream side flow passage member 53) is fitted into the inner circumference of the small diameter part 62*c*. Moreover, the outer circumference of the flange part 54 of the USE unit 51 (the upstream side flow passage member 52) fits into the inner circumference of the second large diameter part 62*b*. In this situation, while a gap occurs between the outer peripheral surface of the trunk part 57 of the upstream side flow passage member 52 and the inner peripheral surface of the second large diameter part 62*b* of the inlet pipe 62, an O-ring 66 is provided in this portion as a seal member for strictly sealing the gap.

Then, in this situation, the tip end part of the outlet pipe 64 of the water supply valve 63 is inserted into and connected with the opening end part side in the inlet pipe 62. In this case, the outer circumference of the tip end part of the outlet pipe 64 is fitted into the inner circumference of the first large diameter part 62*a* of the inlet pipe 62. At the same time as this, the tip end surface of the outlet pipe 64 comes into abutment with the rear end surface of the UFB unit 51 (upstream side flow passage member 52). Moreover, an O-ring 67 for preventing water leakage is also provided between the outer peripheral surface of the small diameter part 64*a* of the outlet pipe 64 and the inner peripheral surface of the first large diameter part 62*a* of the inlet pipe 62.

In the above described configuration, for example, at time of starting the washing step, the water supply valve 63 is opened, and tap water of a relatively high pressure is supplied to the UFB unit 51 from the outlet pipe 64 and flows in the flow passage 55 from the inflow port 55*a* in arrow A direction. In the UFB unit 51, as a result of a narrowed part 55*c* being provided by the protruding part 56 in the middle of the flow passage 55, it is possible to cause air dissolved in water to precipitate as fine bubbles in a large amount. This makes it possible to supply fine bubble water containing a large amount of fine bubbles from the outflow port 55*b* into the water filling case 61 (the detergent storage case) and thus into the water tub 4 through the communication hole 65*a*. Moreover, in the rinsing step, it is possible to supply fine bubble water by supplying water with the water supply valve 63 being opened.

According to such second embodiment, the UFO unit 51 is provided between the water supply valve 63 and the water filling case 61. As a result of this, it is possible to achieve equal operations and effects to those of the above described first embodiment such as that water, which is discharged from the water supply valve 63 and has a relatively high water pressure, can be supplied to the UFB unit 51, and that fine bubbles can be efficiently generated. Further, in addition to that, the following operations and effects can be achieved.

That is, in the present embodiment, the UFB unit 51 is constructed by combining the upstream side flow passage member 52 including the protruding part 56 with the downstream side flow passage member 53 constituting a more downstream side than the protruding part 56. This is because, when the UFB unit is integrally formed of synthetic resin, since especially the shape of the protruding part (narrowed part) becomes fine and complicated, management thereof is difficult, and also production thereof at high quality becomes difficult.

On the contrary, when the UFB unit 51 is formed by combining the upstream side flow passage member 52 and the downstream side flow passage member 53, it is possible to make the shapes of individual parts 52 and 53 relatively simple. Therefore, it is possible to simplify the shape and structure of molding dies, and to simplify and stabilize the production process. In particular, while dimensional control of the protruding part 56 portion is important in determining the performance regarding the generation of fine bubbles, it is possible to provide the protruding part 56 at an end part of the upstream side flow passage member 52. This makes dimensional control of the protruding part 56 portion easier, and allows to achieve a high quality and high performance UPS unit 51 while keeping its cost relatively low.

Moreover, in the present embodiment, the O-ring 66 is provided for air-tightly sealing between the outer peripheral surface of the trunk part 57 of the upstream side flow passage member 52 and the inner peripheral surface of the second large diameter part 62*b* of the inlet pipe 62. Providing the O-ring 66 makes it possible, even when a gap occurs at a butted portion between the upstream side flow passage member and the downstream side flow passage member 53, to prevent bubbles (water containing bubbles) from leaking to the outside of the inlet pipe 62 from the outer circumference of the upstream side flow passage member 52 through the gap. As a result of this, it is possible to securely assemble UPS unit 51 to the inlet pipe 62 while preventing flowing out of fine bubbles and occurrence of pressure loss by means of a simple configuration.

Further, in the present embodiment, a rib 65 by which the tip end surface of the UFB unit 51 is locked is proved in the inlet pipe 62. This makes it possible to easily position the tip end of the UFB unit 51 by means of the rib 65 at the time of assembling the UFB unit 51. Along with this, even when fitting failure occurs between the upstream side flow passage member 52 and the downstream side flow passage member 53, the tip end part of the UFB unit 51 is retained at that position by the rib 65, thus ensuring the flow passage 55.

(3) Third Embodiment and Other Embodiments

Figure 10:
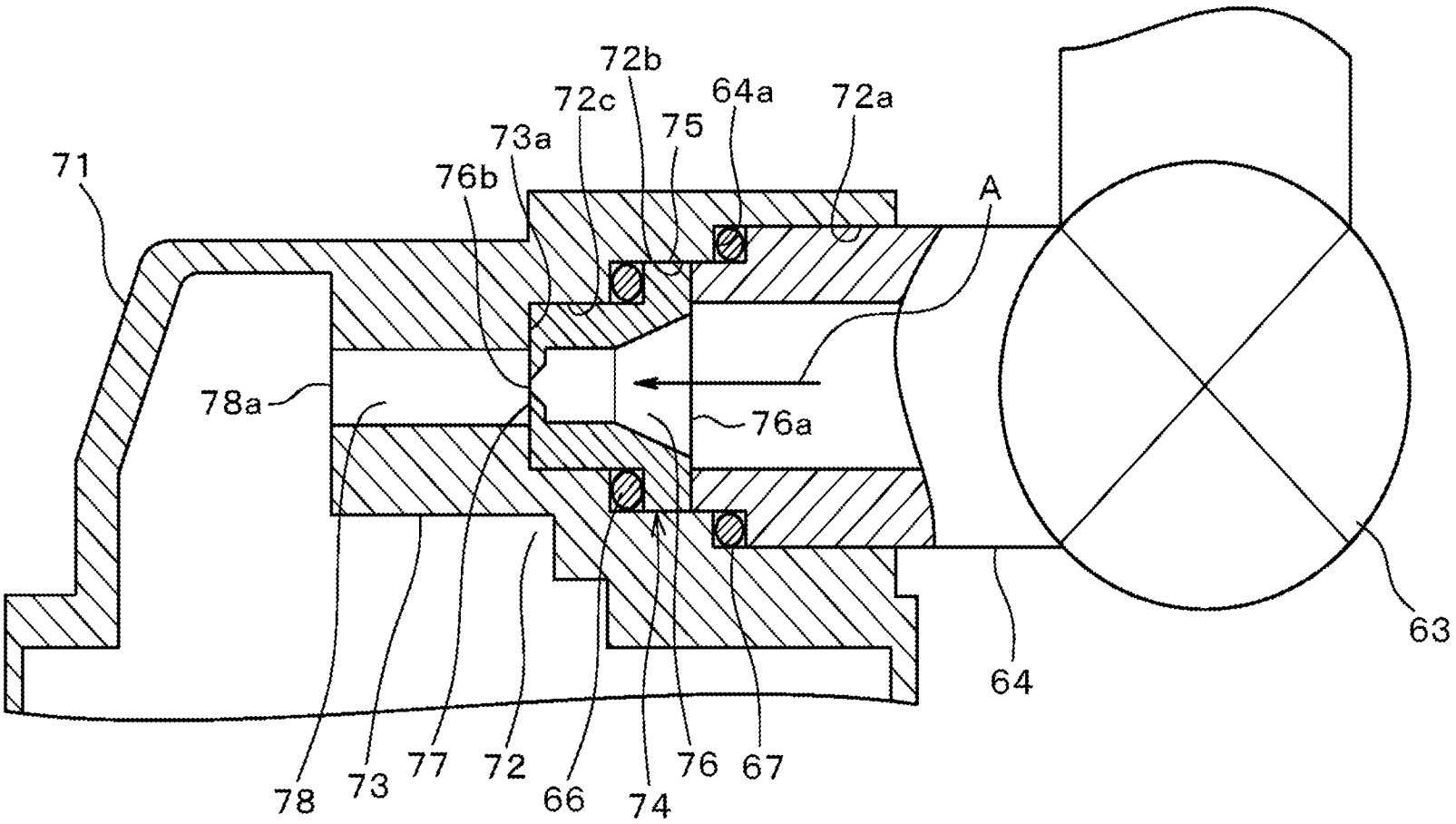
FIG. 10 is a sectional view to show the configuration of an assembly portion of the UFB unit according to a third embodiment.

Next, a third embodiment will be described with reference to FIG. 10. FIG. 10 shows a state in which the fine bubble generation device (UFB unit) according to the present embodiment is assembled by being inserted into the inlet pipe 72 of the water filling case 71, in the present embodiment. The point at which the third embodiment differs from the above described second embodiment is that a communication part 73 which functions as a downstream side flow passage member is integrally provided in the inlet pipe 72 portion, and the fine bubble generation device is made up of the communication part 73 and the upstream side flow passage member 74. That is, the downstream side flow passage member of the above described second embodiment is integrally formed with the inlet pipe 72. In this case, the flow passage of the fine bubble generation device is constituted from the upstream side flow passage of the upstream side flow passage member 74 and the downstream side flow passage of the communication part 73.

That is, the upstream side flow passage member 74 is made from a molding of synthetic resin, substantially as in the above described second embodiment, takes on cylindrical shape having a flange part 75 in a base end part (right end part in the figure), and is configured such that the outer circumference part excepting the flange part 75 has a constant outer diameter. Inside the upstream side flow passage member 74, an upstream side flow passage 76 which constitutes substantially a half part of the upstream side of the flow passage is formed. The upstream side flow passage 76 is reduced in diameter in a tapered shape from a large diameter inlet part 76*a* on the base end side, and thereafter extends in a straight manner. Moreover, a narrowed part 76*b* is formed in the upstream side flow passage 76 by a protruding part 77 integrally provided in the tip end part of the upstream side flow passage member 74.

On the other hand, an outlet pipe 64 of the water supply valve (first water supply valve) 63 is connected to the inlet pipe 72 of the water filling case 71 as in the above described second embodiment. The inlet pipe 72 takes on a shape in which its inner diameter is reduced in three steps in an order from the inlet side (right side in the figure), and is provided with a first large diameter part 72*a*, a second large diameter part 72*b*, and a small diameter part 72*c*. The inner diameter dimension of the first large diameter part 72*a* corresponds to the outer diameter dimension of the above described outlet pipe 64. The inner diameter dimension of the second large diameter part 72*b* corresponds to the outer diameter dimensions of the small diameter part 64*a* of the outlet pipe 64 and the flange part 75 of the above described upstream side flow passage member 74. The inner diameter dimension of the small diameter part 72*c* corresponds to the outer diameter dimension of the upstream side flow passage member 74.

Then, the above described communication part 73 is provided in continuous to the deep side (left side in the figure) of the inlet pipe 72, and has an abutment surface 73*a* with which the tip end surface of the upstream side flow passage member 74 comes into abutment. Along with this, the communication part 73 extends leftward in the figure from the central part of the abutment surface 73*a*, and includes a downstream side flow passage 78 which constitutes substantially a half part of the downstream side of the flow passage. The downstream side flow passage 78 is formed into a straight shape, and its tip end part (left end part in the figure) is configured to be the outflow port 78*a* in communication with inside the water filling case 61 (detergent storage case).

The above described upstream side flow passage member 74 is inserted into the deep side in the inlet pipe 72, and assembled so as to be interposed between the outlet pipe 64 of the water supply valve 63 and the inlet pipe 62. In this occasion, the tip end surface of the upstream side flow passage member 74 comes into abutment with the abutment surface 73*a* of the communication part 73, and outer circumference of substantially a half part on the tip end side of the upstream side flow passage member 74 fits with the inner circumference of the small diameter part 72*c*. The outer circumference of the flange part 54 fits with the inner circumference of the second large diameter part 62*b*. Moreover, an O-ring 66 as a seal member is provided between the outer peripheral surface of the upstream side flow passage member 74 and the inner peripheral surface of the second large diameter part 72*b* of the inlet pipe 72.

Then, in this state, the tip end part of the outlet pipe 64 of the water supply valve 63 is inserted into and connected to the open end part side in the inlet pipe 72. In this case, the outer circumference of the tip end part of the outlet pipe 64 fits into the inner circumference of the first large diameter part 72*a* of the inlet pipe 72. At the same time, the tip end surface of the outlet pipe 64 comes into abutment with the rear end surface of the upstream side flow passage member 64. Moreover, an O-ring 67 for preventing water leakage is provided between the outer peripheral surface of the small diameter part 64*a* of the outlet pipe 64 and the inner peripheral surface of the first large diameter part 72*a* of the inlet pipe 72. As a result of this, the upstream side flow passage 76 of the upstream side flow passage member 74 becomes continuous with the downstream side flow passage 78 of the communication part 73 to constitute a flow passage of the fine bubble generation device.

In the above described configuration, as with the above described second embodiment, it is possible to supply water which is discharged from the water supply valve 63 and has a relatively high water pressure, to the fine bubble generation device, thereby efficiently generating fine bubbles. Moreover, the fine bubble generation device is constituted by combining the upstream side flow passage member 74 with the communication part 73 which plays the function as the downstream side flow passage member. This makes it possible to simplify the shape and structure of molding dies, and simplify and stabilize the production process, thereby achieving a high quality and high performance fine bubble generation device while keeping its cost relatively low.

Then, particularly in the present embodiment, since the downstream side flow passage member (communication part 73) constituting the fine bubble generation device is integrally formed in the inlet pipe 72, a separate downstream side flow passage member becomes obviated. As a result of this, it is possible to reduce the number of parts, and accordingly to achieve further simplification of configuration, improvement in assemblability, and further cost reduction.

Note that the present invention will not be limited to each embodiment as described above, and though not shown, for example the following extensions and modifications can be made. That is, although, in the above described first embodiment, fine bubble water is used in the washing step, and water which has not passed through the UFB unit 31 is used in the rinsing step, for example, it may be configured such that the user switches the water supply valves 29, 30 based on specified operation in the operating panel 4. In this case, it becomes possible to use the two hinds of water (fine bubble water or ordinary water) independently depending on the need, or to mix them for use.

In the above described embodiment, although the UBE unit is provided so as to be interposed between the first water supply valve and the water filling case, it may be configured such that the fine bubble generation device is provided at any point of the water supply path (pipe line) from the water supply valve to the water filling case. Moreover, although in the above described each embodiment, a vertical axis type washing machine is adopted, the present invention can be applied to general types of washing machines such as drum-type washing machines. Besides, the configuration of the water filling case (detergent storage case) and the general configuration of the water supply mechanism may be modified in various ways.

The above described embodiments are provided by way of exemplification and are not intended to limit the scope of the invention. These novel embodiments can be practiced in various other forms, and various omission, substitution, and modification can be made within a range not departing from the spirit of the invention. The present embodiments and variations thereof are intended to be included in the scope and spirit of the invention, and also included in the scope of the invention defined in claims, and equivalents thereof.

The invention claimed is:

1. A washing machine, comprising:

a washing tub in which clothes are stored;

a water supply valve for opening and closing a water supply path that passes water supplied from a water supply source into the washing tub;

a detergent storage case in which detergent is stored; and a fine bubble generation device provided between the water supply valve and the detergent storage case, and for generating fine bubbles.

2. The washing machine according to claim 1, wherein the detergent storage case is provided in a water filling case for filling water into the washing tub, and the fine bubble generation device is located between the water supply valve and the water filling case, and is provided in the water supply path in the water filling case.

3. The washing machine according to claim 2, wherein the fine bubble generation device is arranged downstream of an outlet part of the water supply valve, and in an inlet pipe of water of the water filling case.

4. The washing machine according to claim 2, wherein a small diameter part is provided in the inlet pipe of water of the water filling case, wherein at least a part of an outflow port side of the fine bubble generation device is inserted and connected into the small diameter part.

5. The washing machine according to claim 2, wherein the fine bubble generation device is interposed between the water supply valve and the water filling case.

6. The washing machine according to claim 2, wherein the water supply path is configured such that a flow direction of water discharged from the outlet part of the water supply valve is a same as a flow direction of water in the fine bubble generation device.

7. The washing machine according to claim 2, further comprising:

a second water supply path without including the fine bubble generation device, separate from the water supply path including the fine bubble generation device.

8. The washing machine according to claim 7, wherein a second inlet pipe to which the second water supply path is connected is provided in the water filling case, and a bore of the second inlet pipe is different from a bore of a third inlet pipe to which the fine bubble generation device is connected.

9. The washing machine according to claim 2, wherein the fine bubble generation device is configured to include a narrowed part at a midway part on a flow passage extending from an inflow port to an outflow port, and wherein the fine bubble generation device is constructed by combining an upstream side flow passage member which constitutes an upstream side of the flow passage and includes a protruding part that narrows a flow passage sectional area of the narrowed part, with a downstream side flow passage member which constitutes a more downstream side than the protruding part of the flow passage.

10. The washing machine according to claim 9, wherein the water filling case includes an inlet pipe of water to which the fine bubble generation device is inserted and connected, and the inlet pipe includes a rib by which a tip end surface of the fine bubble generation device is locked.

11. The washing machine according to claim 9, wherein the water filling case includes an inlet pipe of water to which an upstream side flow passage member of the fine bubble generation device is inserted and connected, and the downstream side flow passage member is integrally formed with the inlet pipe.

12. The washing machine according to claim 9, wherein the water filling case includes an inlet pipe of water to which the fine bubble generation device is inserted and connected, and a seal member for air-tightly sealing between an outer surface of the upstream side flow passage member and an inner surface of the inlet pipe.

* * * * *